US007948342B2

(12) United States Patent
Long

(10) Patent No.: US 7,948,342 B2
(45) Date of Patent: May 24, 2011

(54) ELECTROMOTIVE RECTIFICATION SYSTEM

(75) Inventor: John M. Long, Cumming, GA (US)

(73) Assignee: Cutt-A-Watt Enterprises, LLC, Cumming, GA (US)

( * ) Notice: Subject to any disclaimer, the term of this patent is extended or adjusted under 35 U.S.C. 154(b) by 13 days.

(21) Appl. No.: 12/504,763

(22) Filed: Jul. 17, 2009

(65) Prior Publication Data

US 2010/0033283 A1 Feb. 11, 2010

Related U.S. Application Data

(60) Provisional application No. 61/083,402, filed on Jul. 24, 2008.

(51) Int. Cl.
*H01F 27/02* (2006.01)
*H01F 21/02* (2006.01)
*H01F 27/28* (2006.01)

(52) U.S. Cl. ..... 336/90; 336/96; 336/147; 336/222

(58) Field of Classification Search ..... None
See application file for complete search history.

(56) References Cited

U.S. PATENT DOCUMENTS

| | | | | |
|---|---|---|---|---|
| 5,371,466 | A * | 12/1994 | Arakawa et al. | 324/322 |
| 7,312,686 | B2 * | 12/2007 | Bruno | 336/229 |
| 2003/0214313 | A1 * | 11/2003 | Omura et al. | 324/713 |
| 2005/0012581 | A1 * | 1/2005 | Ono et al. | 336/90 |
| 2008/0001693 | A1 * | 1/2008 | Hahn et al. | 336/83 |
| 2008/0266042 | A1 * | 10/2008 | Yoshimura et al. | 336/181 |

* cited by examiner

*Primary Examiner* — Anh T. Mai
*Assistant Examiner* — Mangtin Lian
(74) *Attorney, Agent, or Firm* — Bryan W. Bockhop; Bockhop & Associates, LLP

(57) ABSTRACT

An AC neutral bus electromotive power rectification unit includes a first coil unit and a second coil unit. The first coil unit includes a first conductive wire coil having a first end and an opposite second end. The conductive coil is disposed in a first non-conductive tube and is suspended in a ferrous matrix. The second coil unit includes a second conductive wire coil having a first end and an opposite second end. The first end of the second coil unit is electrically coupled to the first end of the first coil unit. The second coil unit is disposed in a second non-conductive tube and is surrounded by a non-conductive material.

7 Claims, 3 Drawing Sheets

ELECTROMOTIVE RECTIFICATION SYSTEM

CROSS-REFERENCE TO RELATED APPLICATION

This application claims the benefit of U.S. Provisional Patent Application Ser. No. 61/083,402, filed Jul. 24, 2008, the entirety of which is hereby incorporated herein by reference.

BACKGROUND OF THE INVENTION

1. Field of the Invention

The present invention relates to electrical systems and, more specifically, to an electrical system used in cooperation with an electrical power distribution system.

2. Description of the Prior Art

Electrical power systems typically employ a "hot" electrical conductor that delivers current to a location and a "neutral" conductor that allows return of electrical current to its source. Due to mechanical inefficiencies in many household appliances and in industrial machinery, short transient variations in return current can be experienced on the neutral conductor. These transients can make electrical power usage less efficient.

Therefore, there is a need for a system that minimizes the effects of power transients on neutral conductors.

SUMMARY OF THE INVENTION

The disadvantages of the prior art are overcome by the present invention which, in one aspect, is an AC neutral bus electromotive power rectification unit that includes a first coil unit and a second coil unit. The first coil unit includes a first conductive wire coil having a first end and an opposite second end. The conductive coil is disposed in a first non-conductive tube and is suspended in a ferrous matrix. The second coil unit includes a second conductive wire coil having a first end and an opposite second end. The first end of the second coil unit is electrically coupled to the first end of the first coil unit. The second coil unit is disposed in a second non-conductive tube and is surrounded by a non-conductive material.

In another aspect, the invention is an AC neutral bus electromotive power rectification device for use with a neutral bus bar in an electrical power distribution box, in which a plurality of inside neutral wires are coupled to the neutral bus bar and in which one outside neutral wire is coupled to the neutral bus bar. A first coil unit includes a first conductive wire coil having a first end and an opposite second end, The conductive coil is disposed in a first non-conductive tube and is suspended in a ferrous matrix. The second end of the first coil unit is electrically coupled to the neutral bus bar at a first position in which every neutral wire coupled to the neutral bus bar lies between the first position and a second position at which an outside neutral wire is coupled to the neutral bus bar. The second coil unit includes a second conductive wire coil having a first end and an opposite second end. The first end of the second coil unit is electrically coupled to the first end of the first coil unit. The second coil unit is disposed in a second non-conductive tube and is surrounded by a non-conductive material. The second end of the second coil unit is electrically coupled to the second position at which an outside neutral wire is coupled to the neutral bus bar.

In yet another aspect, the invention is an electrical power distribution unit that includes an electrical power distribution box, which includes a neutral bus bar. A plurality of inside neutral wires is coupled to the neutral bus bar between a first position and an opposite second position. An outside neutral wire is coupled to the neutral bus bar adjacent to the second position. A first coil unit includes a first conductive wire coil having a first end and an opposite second end. The conductive coil is disposed in a first non-conductive tube and is suspended in a ferrous matrix. The second end of the first coil unit is electrically coupled to the neutral bus bar at the first position. A second coil unit includes a second conductive wire coil having a first end and an opposite second end. The first end of the second coil unit is electrically coupled to the first end of the first coil unit. The second coil unit is disposed in a second non-conductive tube and is surrounded by a non-conductive material. The second end of the second coil unit is electrically coupled to adjacent to the second position. The first coil unit and the second coil unit are both disposed in a housing. The housing is filled with an insulating material.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
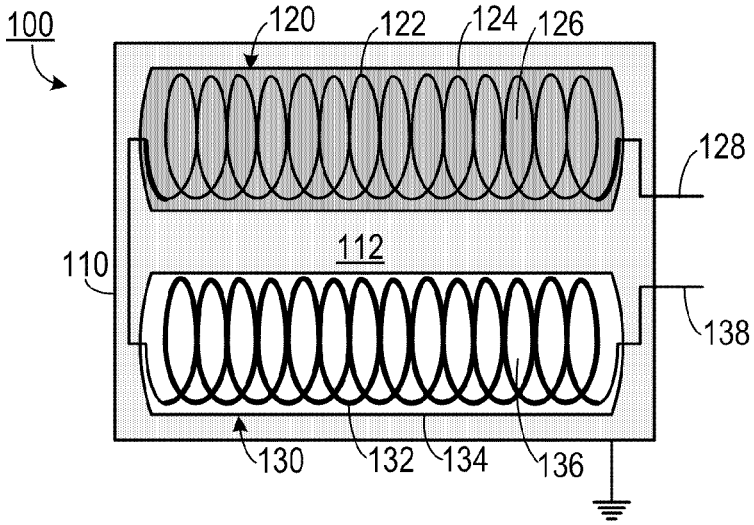
FIG. 1 is a schematic diagram of an embodiment of an electromotive rectification system.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "an," and "the" includes plural reference, the meaning of "in" includes "in" and "on."

As shown in FIG. 1, one representative embodiment of a electromotive rectification system 100 includes a housing 110, preferably made of a conductive material such as a metal that is grounded, in which is disposed a first coil unit 120 and a spaced-apart second coil unit 130. In an alternate embodiment, the housing 110 could include a non-conductive material, such as a plastic or fiberglass.

The first coil unit 120 includes a non-insulated conductive coil 122. In a residential embodiment, the coil 122 includes a 10-gauge or a 12-gauge solid copper wire coil including about 13 to 14 turns and having an inside diameter of about 5/16 inches. A first contact 128 extends from the housing 110. The coil 122 is disposed in a non-conductive tube 124, such as a poly-vinyl chloride (PVC) tube 124 and is suspended in micro-scale ferrous filings 126.

The second coil unit 130 includes an insulated conductive coil 132. In a residential embodiment, the coil 132 includes a 10-gauge or a 12-gauge solid copper or aluminum wire coil including about 13 to 14 turns and having an inside diameter of about 5/16 inches. A second contact 138 extends from the housing 110. The coil 132 is disposed in a non-conductive tube, such as a poly-vinyl chloride (PVC) tube 134 and is suspended in air 136 or another insulating medium.

While the first coil unit 120 and the second coil unit 130 are shown being disposed in parallel in the housing 110, the relative orientation of these units is not important. The coil units 120 and 130 may be suspended in an insulating material 112, such as epoxy, to provide mechanical stability to the units.

Figure 2:
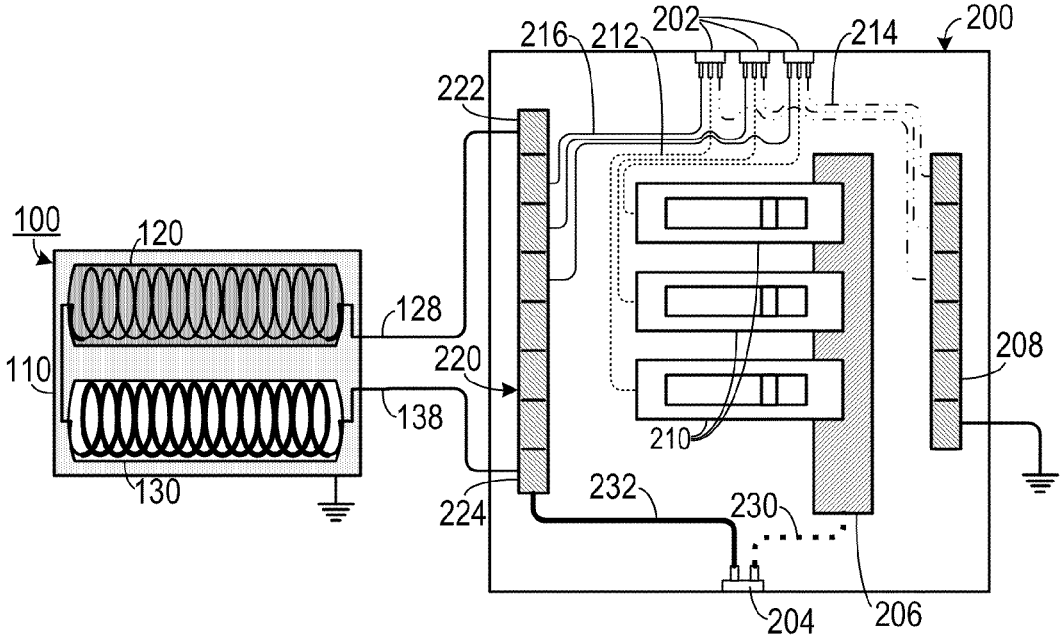
FIG. 2 is a schematic diagram of an embodiment of an electromotive rectification system coupled to an electric power distribution panel.

As shown in FIG. 2, the electromotive rectification system 100 is coupled to a breaker panel 200 (sometimes referred to as an "electric power distribution panel"). The breaker panel 200 would typically include several inside power cables 202, each including a hot wire 212, a ground wire 214 and a neutral wire 216. Each hot wire 212 is coupled to a breaker 210, which is coupled to a hot power bus bar 206. Each ground wire 214 is coupled to a ground bus bar 208 that is grounded. Each neutral wire 216 is coupled to a neutral bus bar 220.

An outside cable 204 brings electricity from a power utility to the breaker panel 200. The outside cable includes an outside hot wire 230 and an outside neutral wire 232.

The first contact 128 is coupled neutral bus bar 220 at a first neutral contact 222 and the second contact 138 is coupled neutral bus bar 220 at a second neutral contact 224. The first neutral contact 222 is electrically spaced apart from the second neutral contact 224 so that all neutral wires 216 contact the neutral bus bar 220 between the first neutral contact 222 and the second neutral contact 224.

Figure 3:
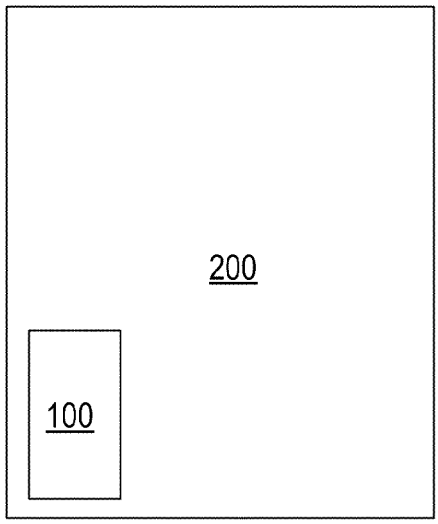
FIG. 3 is a schematic diagram of an embodiment of an electromotive rectification system integrated with an electric power distribution panel.

As shown in FIG. 3, the electromotive rectification system 100 may be integrated with the breaker panel 200.

Figure 4:
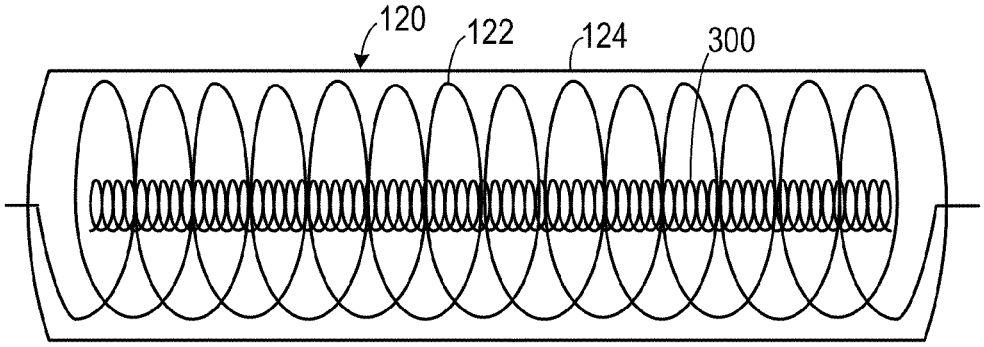
FIG. 4 is a schematic diagram of an alternate embodiment of a first coil unit.

As shown in FIG. 4, in one alternate embodiment, the first coil unit 120 would not employ ferrous filings, but would employ a mag wire coil 300 that is electrically isolated from the coil 122.

Figure 5A:
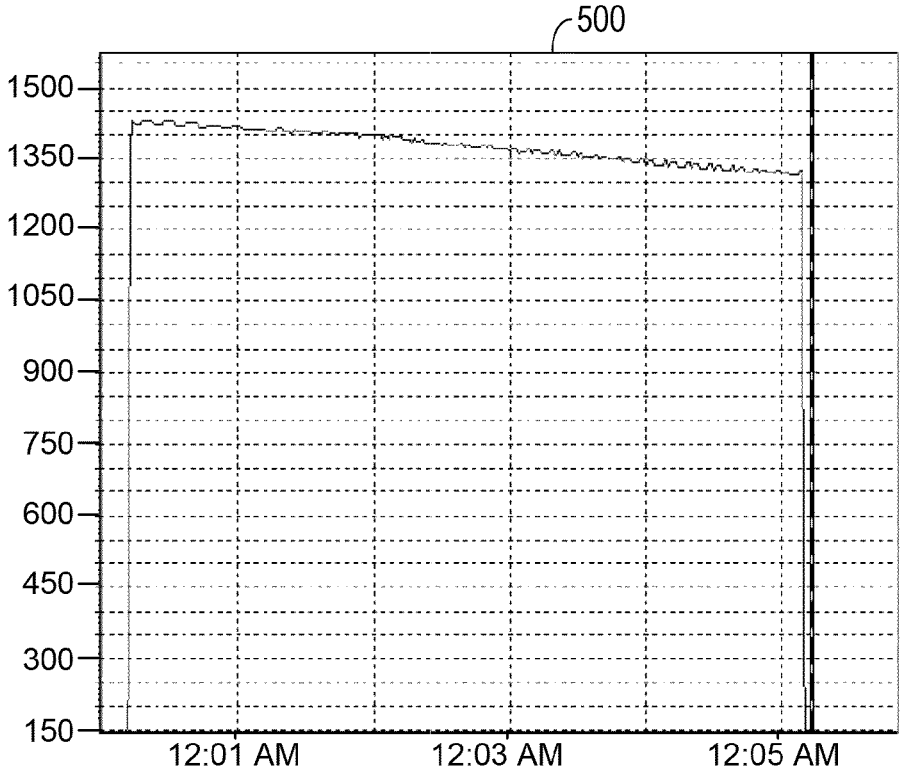
FIG. 5A is a graph showing power consumption recorded at a breaker box connected to a single appliance operating over time without the invention being employed.
Figure 5B:
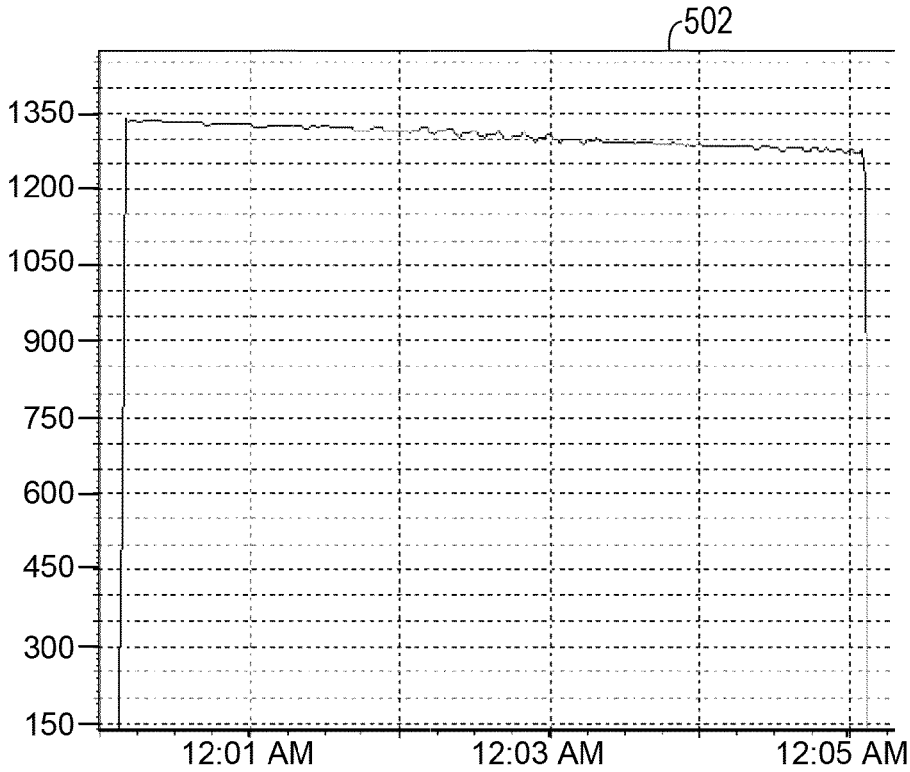
FIG. 5B is a graph showing power consumption recorded at a breaker box connected to a single appliance operating over time with the invention being employed.

In one experimental embodiment, as shown in FIGS. 5A-5A power consumption during a four minute period was recorded at a breaker box while a single household appliance was operated. The power consumption 500, shown in FIG. 5A, while the invention was not connected to the breaker box was about 5% greater than the power consumption 502, shown in FIG. 5B, while the invention was connected to the breaker box.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An AC neutral bus electromotive power rectification unit, comprising:

a. a first coil unit, including a first conductive wire coil having a first end and an opposite second end, the conductive wire coil disposed in a first non-conductive tube and suspended in a ferrous matrix disposed in the first non-conductive tube; and b. a second coil unit, including a second conductive wire coil having a first end and an opposite second end, the first end of the second coil unit being electrically coupled to the first end of the first coil unit, the second coil unit disposed in a second non-conductive tube, different from the first non-conductive tube, and surrounded by a non-conductive material disposed in the second non-conductive tube, wherein the second tube does not have a ferrous matrix disposed therein.

2. The AC neutral bus electromotive power rectification unit of claim 1, wherein the first conductive wire coil and the second conductive wire coil each comprise between ten and fifteen turns of copper wire.

3. The AC neutral bus electromotive power rectification unit of claim 1, wherein the ferrous matrix comprises a plurality of micro-scale ferrous filings.

4. The AC neutral bus electromotive power rectification unit of claim 1, wherein the first non-conductive tube and the second non-conductive tube comprise poly vinyl chloride.

5. The AC neutral bus electromotive power rectification unit of claim 1, further comprising a housing in which the first coil unit and the second coil unit are both disposed.

6. The AC neutral bus electromotive power rectification unit of claim 5, wherein the housing is filled with an insulating material.

7. The AC neutral bus electromotive power rectification unit of claim 6, wherein the insulating material comprises epoxy.

* * * * *